United States Patent [19]

Robinson

[11] 4,005,540

[45] Feb. 1, 1977

[54] GUN TRIGGER MECHANISM

[75] Inventor: Marion M. Robinson, Schaumburg, Ill.

[73] Assignee: Kanematsu-Gosho (U.S.A.), Inc., Arlington Heights, Ill.

[22] Filed: Aug. 27, 1975

[21] Appl. No.: 608,213

[52] U.S. Cl. ..... 42/69 R; 42/69 A

[51] Int. Cl.[2] ..... F41C 19/02

[58] Field of Search ..... 42/69 A, 69 B, 69 R, 42/41

[56] References Cited

UNITED STATES PATENTS

| | | | |
|---|---|---|---|
| 620,796 | 3/1899 | Newell et al. | 42/69 R |
| 959,413 | 5/1910 | Williams | 42/69 R |
| 1,243,120 | 10/1917 | Williams | 42/69 A |
| 1,625,768 | 4/1927 | Barnes | 42/69 A |
| 1,699,881 | 1/1929 | Elliott | 42/69 A |
| 2,556,025 | 6/1951 | Canjar | 42/69 A |
| 2,558,872 | 7/1951 | Miller | 42/69 A |
| 3,206,884 | 9/1965 | Purvis | 42/69 A |
| 3,443,333 | 5/1969 | Manatos | 42/69 R |

FOREIGN PATENTS OR APPLICATIONS

| | | | |
|---|---|---|---|
| 49,314 | 9/1931 | Norway | 42/69 R |

*Primary Examiner*—Charles T. Jordan
*Attorney, Agent, or Firm*—Wagner, Stellman, McCord, Wiles & Wood

[57] ABSTRACT

An improved gun trigger mechanism providing selectively different pull poundage requirements. The mechanism utilizes two different spring structures for effecting selectively the different pull requirements.

18 Claims, 8 Drawing Figures

10
11
13
14
15
16
12

14
3
18
30
27
19
20
34
40
39
17
16
3
12

13
29
30
18
19
20
14

8.
16
17
18
19
20
21
23
24
25
26
27
28
29
30
31
32
33
34
35
36
37
38
39
40
41
42
43
44
45
46
47
48
49
50

14
22
23
24
19
21
18
25
26
30
20
31
32
33
34
27
28
29
44
42
17
39
40
16

45
47
46
18
48
31
38
39
33
37
34
44
43
40
42
41

GUN TRIGGER MECHANISM

BACKGROUND OF THE INVENTION

1. Field of the Invention

This invention relates to firearms and in particular to trigger mechanisms for use in firearms.

2. Description of the Prior Art

In the conventional fierarm, a trigger is provided for holding a sear which, in turn, controls the release of a spring-loaded firing pin. When the trigger is pulled to become disengaged from the sear, the relatively heavily loaded firing pin assembly causes the sear to move suitably to permit the firing pin assembly to fall and effect the desired ignition of the cartridge.

The conventional firearm provides a set poundage required for effecting the trigger pull. The pull on the trigger is conventionally resisted by spring means which provides the preselected set poundage requirement.

For certain applications, it is desirable to utilize a light pull, which may be substantially less than the conventional three to five pound pull, and illustratively, may be only several ounces.

SUMMARY OF THE INVENTION

The present invention comprehends an improved trigger mechanism which permits the user of the firearm to select either of two different poundages in effecting the release of the sear by the trigger pull. The poundages may comprise a conventional, relatively heavy poundage and a light poundage as desired.

The invention comprehends the provision of such a mechanism wherein an auxiliary finger loop blade provided in addition to the normal finger loop blade is adapted to effect a light pull operation of the trigger mechanism when suitably arranged therein.

More specifically, the invention comprehends the provision of a trigger blade structure adapted to release the sear of the firearm as a result of a pull thereon against a relatively heavy spring action to provide the conventional relatively heavy poundage pull action. An auxiliary finger loop blade associated with the normal finger loop blade is brought into operative disposition by a forward movement of both finger loop blades to a preselected forward light pull position. In this position, the finger loop blades are retained by means of a relatively light spring and releasable interlock.

In the illustrated embodiment, the release of the light pull auxiliary blade causes a release of the entire trigger mechanism to overcome the heavy pull spring by kinetic energy in effecting the desired release of the sear.

The finger loop blades may be enclosed in a trigger shoe having a suitable opening to permit selective extension of a finger-engaging portion of the auxiliary blade outwardly therefrom in the light pull position.

The amount of kinetic energy developed in the release of the auxiliary blade to effect the light trigger pull operation may be preselected by means of a compression spring biasing the blade assembly against the holding action of the spring-controlled interlock means.

The trigger mechanism of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figures 1, 2, 3:
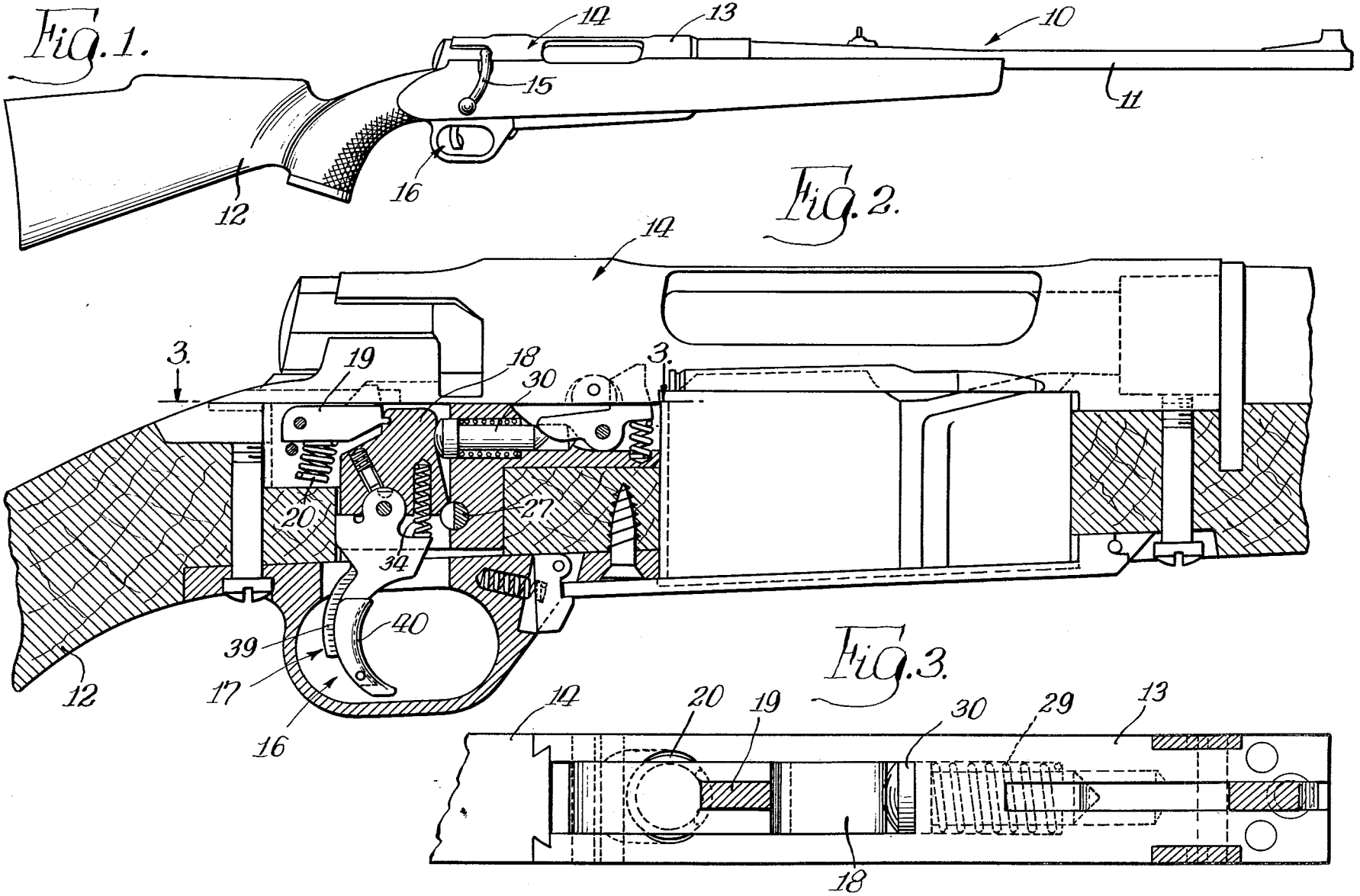
FIG. 1 is a side elevation of a firearm having a trigger mechanism embodying the invention.
FIG. 2 is a fragmentary enlarged longitudinal section thereof.
FIG. 3 is a fragmentary horizontal section taken substantially along the line 3—3 of FIG. 2.

In the exemplary embodiment of the invention as disclosed in the drawing, a firearm generally designated 10 illustratively comprises a rifle having a barrel 11 and a stock 12. The firearm is arranged to receive suitable cartridges in a firing chamber 13 to be fired by a firing pin assembly generally designated 14. In one conventional form of such rifle, a bolt 15 is provided for arranging the mechanism in firing condition. Control of the firing of the cartridges is effected by means of a trigger mechanism generally designated 16. The present invention comprehends an improved trigger mechanism permitting the user of the firearm to effect firing of the cartridges by either of two different pulls. Illustratively, the trigger mechanism may be arranged to permit a conventional trigger operation, such as with a three to five pound pull, and a light trigger operation with a pull of only several ounces.

The trigger mechanism includes a finger loop structure generally designated 17 which controls the disposition of an upper trigger piece 18 for selectively holding and releasing a sear 19. Release of the sear permits release of the firing pin assembly to effect the desired firing of the cartridge in the conventional firing manner.

Figure 7:
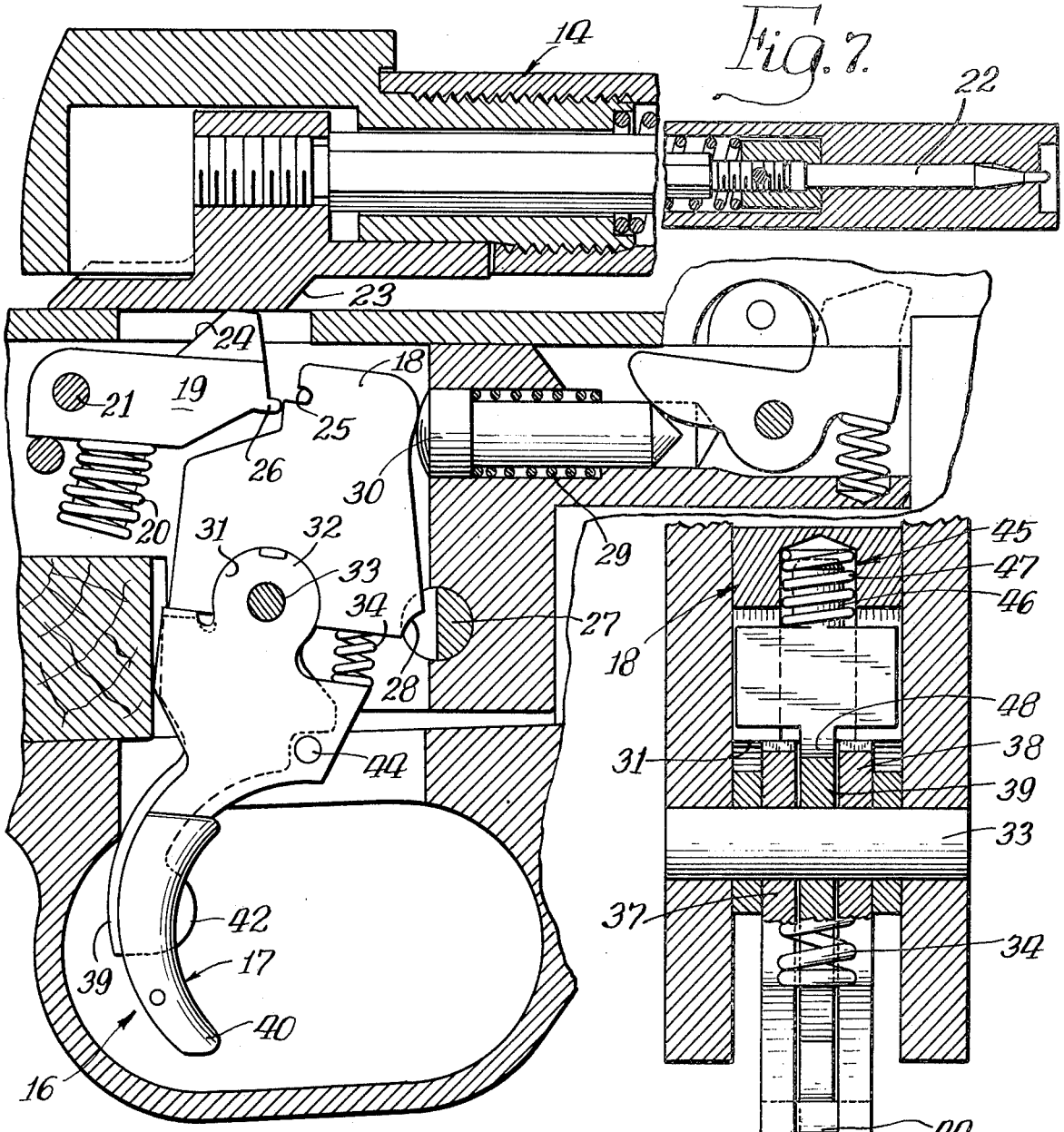
FIG. 7 is a fragmentary longitudinal section illustrating the arrangement of the trigger mechanism upon release of the sear.
Figure 8:
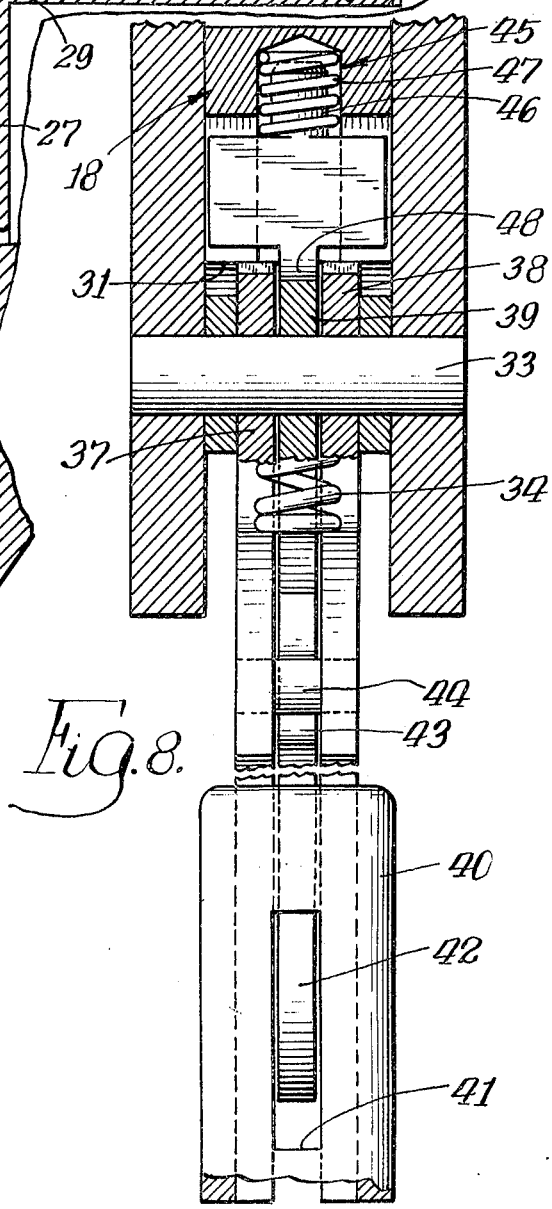
FIG. 8 is a vertical section taken substantially along the line 8—8 of FIG. 4.

Firing pin assembly 14 is heavily spring-loaded to overcome a positioning spring 20 biasing the sear in a counterclockwise direction, as seen in FIG. 7, about a pivot 21, whereby the firing pin 22 is caused to move forwardly to strike the cartridge primarily for igniting the cartridge. Thus, the firing pin assembly 14 is provided with a shoulder 23 cooperating with a complementary shoulder 24 on the sear to effect the desired release movement of the sear in effecting the firing of the cartridge.

As indicated above, the sear is normally retained in the cocked position by the upper trigger piece 18 which is provided with a recess 25 adapted to receive a projection 26 on the sear. The upper trigger piece may be locked in position to prevent release of the firing pin by a suitable lock element 27 engaging a shoulder 28 on element 18 in a safety arrangement of the mechanism. The upper trigger piece is biased to the sear-holding position of FIG. 1 by a heavy compression spring 29 acting through a plunger 30 against the upper trigger piece, as shown in FIG. 4.

To overcome spring 29 and effect suitable movement of the upper trigger piece to release the sear projection 26, the trigger mechanism 16 is operated by a rearward finger pull on the finger loop structure 17.

Figures 4, 5, 6:
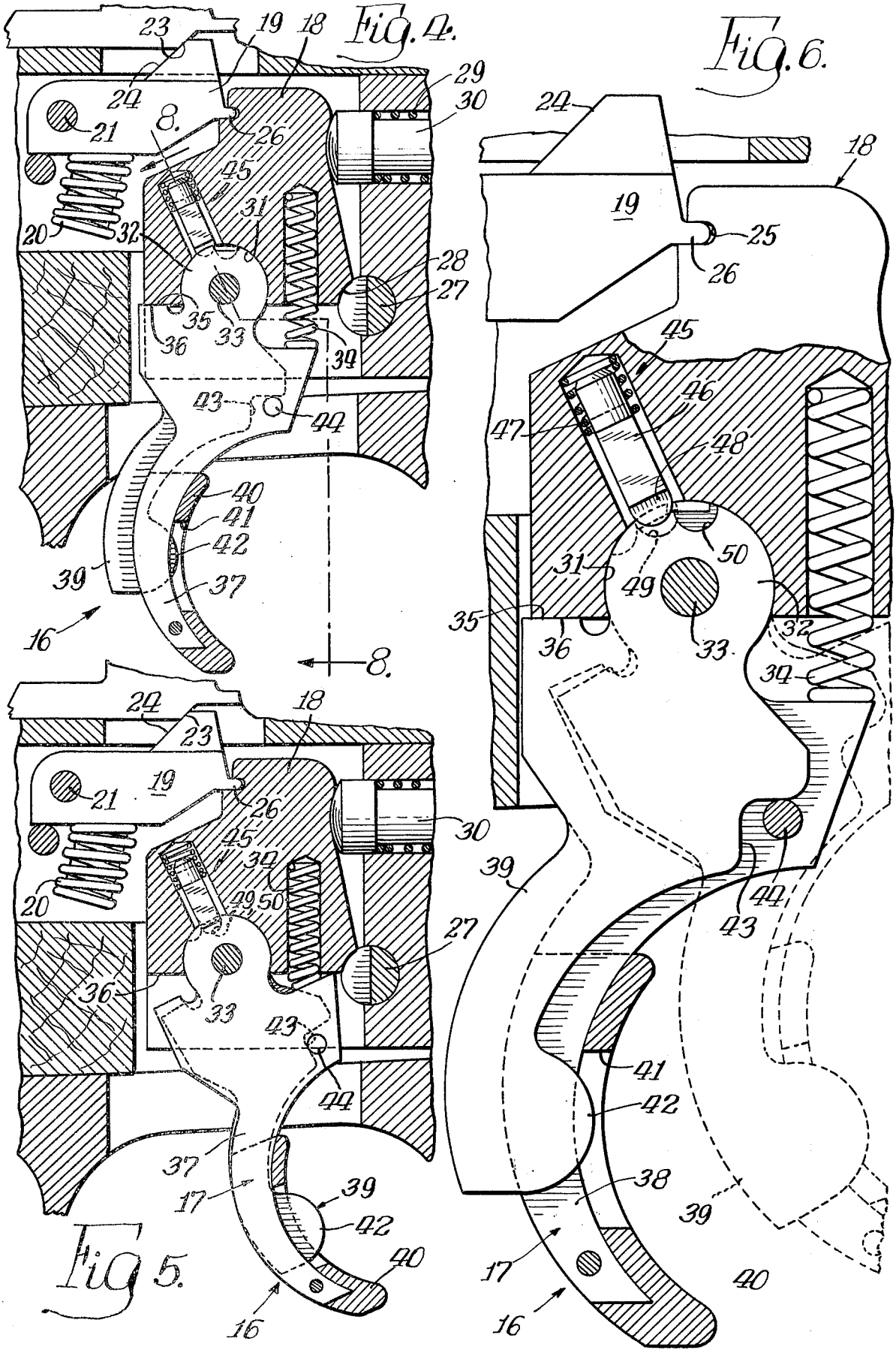
FIG. 4 is a fragmentary further enlarged longitudinal section thereof with the trigger arranged in the normal poundage pull disposition.
FIG. 5 is a fragmentary further enlarged longitudinal section thereof with the trigger arranged in the light poundage pull disposition.
FIG. 6 is a further enlarged section.

As shown in FIG. 4, upper trigger piece 18 is provided with a socket 31 fitted to a pivot portion 32 of the trigger mechanism 16. Portion 32, in turn, is pivotally mounted on a pivot 33. Thus, spring 29 biases the upper trigger piece 18 in a counterclockwise direction about pivot 33 and movably on trigger mechanism portion 32.

The trigger mechanism, in turn, is biased in a clockwise direction about pivot 33 by a spring 34 to abut a shoulder 35 on the trigger mechanism with a shoulder 36 on upper trigger piece 18 whereby rearward pull on the trigger mechanism effects a clockwise pivoting of the upper trigger piece 18 against the action of spring 29 to effect the normal release of sear 19. As the spring 29 is relatively heavy, the pull on trigger mechanism 16 to effect such release of the sear may be relatively heavy, such as in the range of three to five pounds.

As indicated above, trigger mechanism 16 is further arranged to permit a light pull firing operation by a selective different disposition of the trigger mechanism. More specifically, as illustrated in FIGS. 5 and 6, the finger loop structure 17 includes a pair of outer finger loop blades 37 and 38 and an inner finger loop blade 39, which is sandwiched between the outer loop blades and which is movable relative to the outer finger loop blades, as illustrated in FIGS. 5 and 6. The three blades are enclosed in an outer trigger shoe 40 (FIG. 2), which is provided with a front slot 41 adapted to freely pass a forwardly projecting portion 42 of blade 39 when the middle blade is swung in a counterclockwise direction on pivot 33 relative to the outer finger loop blades. Such swinging is effected by a movement of the entire finger loop structure 17 forwardly from the normal set position of FIG. 2 to a light pull position of FIG. 5. In the normal pull position of the finger loop structure, as shown in FIG. 4, the middle blade 39 is retracted so as to dispose portion 42 within the slot 41 of the trigger shoe 40 so that in the normal trigger pull, the user's finger does not engage the middle blade 39.

The forward movement of middle blade 39 relative to the outer blades 37 and 38 is limited by the abutment of a shoulder 43 on middle blade 39 with a stop pin 44 extending between the outer blades 37 and 38, as illustrated in FIG. 5.

The finger loop structure is biased away from the light pull setting of FIG. 5 by the spring 34 in a clockwise direction, as shown in FIG. 5. To retain the finger loop structure in the light pull position, an interlock generally designated 45 is provided which includes a plunger 46 urged by a compression spring 47 toward pivot portion 32 of the finger loop structure. In the forward set position, the nose 48 of plunger 46 is urged into detent recess 49 in the outer finger loop blades and a recess 50 in the middle finger loop blade. As shown in FIG. 6, recess 50 is disposed forwardly of recesses 49 when the finger loop structure is arranged in the normal heavy pull configuration. Thus, when the finger loop structure is moved forwardly to the light pull position of FIG. 5, the middle blade 39 is held in forwardly extended relationship to the finger loop blades 37 and 38 by the interlock action of the nose portion in the detent recesses 49 and 50, with the projecting portion 42 of the middle blade 39 disposed forwardly of the trigger shoe 40. In this arrangement, coil spring 34 is compressed and is tending to urge the finger loop structure rearwardly, or in a clockwise direction, with the rearward movement being prevented by the relatively light spring 47 maintaining the plunger nose 48 in the detent recesses 49 and 50.

However, as the spring 47 is relatively light, the middle blade may be readily moved rearwardly, or in a clockwise direction, from the position of FIG. 5 by a light pull thereon, which may be in the order of several ounces. Such pull urges the plunger 46 outwardly to retract the nose portion 48 from the detent recesses 49 and 50 and allow the entire finger loop structure to be urged rearwardly, or in a clockwise direction, from the light pull position of FIG. 5, to the normal position of FIG. 4. The kinetic energy, at this time, of the spring 34 and finger loop structure is preselected to assure that the finger loop structure continues to move rearwardly against the action of spring 29 to swing the upper trigger piece 18 in a clockwise direction about pivot 33, as shown in FIG. 7, to release the sear projection 26 and permit the spring-loaded firing pin to move forwardly and fire the cartridge.

In the illustrated embodiment, the forward displacement of the finger loop structure from the normal position to the light pull position may be approximately 25°. The spring constants may be selected as desired to provide any desired combination of trigger pulls. In the illustrated embodiment, the outer blades 37 and 38 of the finger loop structure may be fixedly secured to the trigger shoe and the shoe may be arranged to pass the middle blade 39 rearwardly therefrom in the normal setting of the trigger mechanism as shown in FIG. 4.

While the present invention is illustrated in connection with a bolt action rifle, as will be obvious to those skilled in the art, the inventive concept embodied in the improved combination trigger mechanism may be utilized with other forms of firearms within the scope of the invention.

The foregoing disclosure of specific embodiments is illustrative of the broad inventive concepts comprehended by the invention.

I claim:

1. A firearm trigger mechanism comprising: a trigger piece; means for movably mounting said trigger piece for releasably holding a sear against firing movement; first spring means for urging said trigger piece to a sear holding position; a finger loop blade having a pivot portion pivotally mounting said trigger piece; pivot means for pivotally mounting said blade adjacent said trigger piece for selectively effecting a sear releasing movement of said trigger piece as a result of a finger pull on said blade rearwardly from a first pull position against the biasing action of said first spring means; relatively lightly biased detent means for holding the finger loop blade in a second, light pull position forwardly of said first pull position; and second, relatively strong spring means for moving said finger loop blade rearwardly from said light pull position upon release of said detent means to cause sufficient force to be developed in said finger loop blade to effect said sear releasing movement of said trigger piece, said pivot portion being coaxial of said pivot means whereby said trigger piece and said finger loop blade are coaxially pivotable.

2. The firearm trigger mechanism of claim 1 wherein said detent means comprises an element carried by said trigger piece having a rounded surface, notch means on said finger loop blade, and third spring means for urging said rounded surface of said element into said notch means.

3. The firearm trigger mechanism of claim 1 wherein said detent means comprises an element carried by said trigger piece having a rounded surface, notch means on said finger loop blade, and third spring means carried by said trigger piece for urging said rounded surface of said element into said notch means.

4. The firearm trigger mechanism of claim 1 wherein said finger loop blade defines shoulder means abutted to said trigger piece to effect said sear releasing movement thereof.

5. The firearm trigger mechanism of claim 1 wherein said finger loop blade defines shoulder means abutted to said trigger piece to effect said sear releasing movement thereof, said second spring means urging said shoulder into abutment with said trigger piece.

6. The firearm trigger mechanism of claim 1 wherein said second spring means is carried by said trigger piece.

7. The firearm trigger mechanism of claim 1 wherein said second spring means comprises a helical spring compressed between said trigger piece and said finger loop blade.

8. A firearm trigger mechanism comprising: a trigger piece for releasably holding a sear against firing movement; first spring means for urging said trigger piece to a sear holding position; a first finger loop blade having a pivot portion pivotally mounting said trigger piece; pivot means for pivotally mounting said first blade for selectively effecting a sear releasing movement of said trigger piece as a result of a finger pull on said first blade rearwardly from a first pull position against the biasing action of said first spring means; relatively lightly biased detent means for holding the first finger loop blade in a second, light pull position forwardly of said first pull position; a second finger loop blade, said pivot means pivotally mounting said second finger loop blade adjacent said first finger loop blade; means on said second finger loop blade for releasing said detent means as a result of a light finger pull on said second finger loop blade; and second, relatively strong spring means for moving said second finger loop blade rearwardly from said light pull position upon release of said detent means to cause sufficient force to be developed in said finger loop blades to effect said sear releasing movement of said trigger piece, said pivot portion being coaxial of said pivot means whereby said trigger piece, said first finger loop blade and said second finger loop blade are coaxially pivotable.

9. The firearm trigger mechanism of claim 8 wherein said second finger loop blade is pivotally mounted coaxially of said first finger loop blade.

10. The firearm trigger mechanism of claim 8 wherein said second finger loop blade is pivotally mounted coaxially of said first finger loop blade for movement with said first finger loop blade in effecting said sear releasing movement of said trigger piece.

11. The firearm trigger mechanism of claim 8 wherein said second finger loop blade is pivotally mounted coaxially of said first finger loop blade and includes a front portion displaced forwardly from said first finger loop blade in the light pull position of said first finger loop blade to permit release of said detent means by a rearward finger pull movement of said second finger loop blade only.

12. The firearm trigger mechanism of claim 8 wherein said detent means comprises an element carried by said trigger piece having a rounded surface, notch means on each of said finger loop blades, and third spring means for urging said rounded surface of said element into said notch means.

13. The firearm trigger mechanism of claim 8 wherein said detent means comprises an element carried by said trigger piece having a rounded surface, notch means on each of said finger loop blades, and third spring means for urging said rounded surface of said element into said notch means, the notch means on said second finger loop blade being disposed to position a portion of said second finger loop blade forwardly of said first finger loop blade in the light pull position of said first finger loop blade to permit release of said detent means by a rearward finger pull movement of said second finger loop blade only.

14. The firearm trigger mechanism of claim 8 wherein said second spring urges each of said finger loop blades rearwardly from said light pull position.

15. The firearm trigger mechanism of claim 8 wherein a pair of first finger loop blades are provided, said second finger loop blade being sandwiched therebetween.

16. The firearm trigger mechanism of claim 8 wherein a pair of first finger loop blades are provided, said second finger loop blade being sandwiched therebetween, said blades being embraced by a trigger shoe.

17. The firearm trigger mechanism of claim 8 wherein said means for movably mounting said trigger piece comprises pivot means on said blades pivotally carrying said trigger piece.

18. The firearm trigger mechanism of claim 8 wherein a pair of first finger loop blades are provided, said second finger loop blade being sandwiched therebetween, said blades being embraced by a trigger shoe having a front opening, said second finger loop blade having a projection extending forwardly through said opening in the light pull position of said first finger loop blade to permit release of said detent means by a rearward finger pull movement of said second finger loop blade only.

* * * * *